US009838767B2

(12) United States Patent
Northemann

(10) Patent No.: US 9,838,767 B2
(45) Date of Patent: Dec. 5, 2017

(54) METHOD AND MEANS FOR REGULATING THE ELECTRICAL BIAS VOLTAGE AT THE MEASURING CAPACITOR OF A MEMS SENSOR ELEMENT

(71) Applicant: Robert Bosch GmbH, Stuttgart (DE)

(72) Inventor: Thomas Northemann, Gerlingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/116,619

(22) PCT Filed: Dec. 1, 2014

(86) PCT No.: PCT/EP2014/076056

§ 371 (c)(1),
(2) Date: Aug. 4, 2016

(87) PCT Pub. No.: WO2015/117690

PCT Pub. Date: Aug. 13, 2015

(65) Prior Publication Data

US 2016/0360304 A1 Dec. 8, 2016

(30) Foreign Application Priority Data

Feb. 5, 2014 (DE) ..... 10 2014 202 009

(51) Int. Cl.

| | |
|---|---|
| ***H04R 1/04*** | (2006.01) |
| ***H04R 29/00*** | (2006.01) |
| ***H04R 3/06*** | (2006.01) |
| ***H04R 19/01*** | (2006.01) |

(52) U.S. Cl.

CPC ..... *H04R 1/04* (2013.01); *H04R 3/06* (2013.01); *H04R 19/016* (2013.01); *H04R 29/004* (2013.01); *H04R 2201/003* (2013.01)

(58) Field of Classification Search

None

See application file for complete search history.

(56) References Cited

U.S. PATENT DOCUMENTS

| | | | |
|---|---|---|---|
| 8,995,690 | B2 | 3/2015 | Hammerschmidt et al. |
| 2006/0273805 | A1 | 12/2006 | Peng et al. |
| 2011/0056302 | A1 | 3/2011 | Lutz |
| 2012/0014541 | A1 | 1/2012 | Nakayama |

(Continued)

FOREIGN PATENT DOCUMENTS

| | | |
|---|---|---|
| DE | 60133679 | 6/2009 |
| DE | 102012221795 | 5/2013 |
| WO | 2014174283 | 10/2014 |

OTHER PUBLICATIONS

Tietze et al., "Halbleiter-Schaltungstechnik", Springer-Verlag Berlin Heidelberg, 2002, XP002303807, pp. 1146-1148.

(Continued)

*Primary Examiner* — Maria El-Zoobi
*Assistant Examiner* — Kenny Truong
(74) *Attorney, Agent, or Firm* — Norton Rose Fulbright US LLP; Gerard Messina

(57) ABSTRACT

Measures for regulating the electrical bias voltage at the measuring capacitor of a MEMS sensor element are described. A base voltage is applied to the measuring capacitor and regulated in such a way that the potential difference between the two electrode sides of the measuring capacitor corresponds to the setpoint voltage. The base voltage is regulated in a low-voltage range.

4 Claims, 2 Drawing Sheets

(56) References Cited

U.S. PATENT DOCUMENTS

| | | | |
|---|---|---|---|
| 2013/0279717 | A1 | 10/2013 | Reimann et al. |
| 2016/0157017 | A1 | 6/2016 | Lesso et al. |

OTHER PUBLICATIONS

International Search Report dated May 27, 2015, of the corresponding International Application PCT/EP2014/076056 filed Dec. 1, 2014, 2 pages.

METHOD AND MEANS FOR REGULATING THE ELECTRICAL BIAS VOLTAGE AT THE MEASURING CAPACITOR OF A MEMS SENSOR ELEMENT

BACKGROUND INFORMATION

The present invention relates to a method and device for regulating the electrical bias voltage at the measuring capacitor of a MEMS sensor element, in which a base voltage is applied to the measuring capacitor, and in which this base voltage is subsequently regulated in such a way that the potential difference between the two electrode sides of the measuring capacitor corresponds to the setpoint voltage.

The regulation of the electrical bias voltage at the measuring or microphone capacitor of MEMS microphones is of particular significance. These generally include a sound pressure-sensitive diaphragm and a fixed counter-element. The diaphragm and the counter-element act as supports for the flat electrodes of the microphone capacitor, so that the changes of the distance between the diaphragm and the counter-element caused by sound pressure are detectable as capacitance fluctuations of the microphone capacitor. To increase the sensitivity of such MEMS microphones, a mechanical preload is applied to the diaphragm by applying a direct voltage to the microphone capacitor. This draws the diaphragm toward the counter-element electrostatically, the electrostatic force of the direct voltage counteracting the spring force of the diaphragm. This direct voltage may only be increased to the so-called pull-in point, at which the electrostatic force is equal to the spring force of the diaphragm. If the pull-in voltage is exceeded, the diaphragm snaps abruptly against the counter-element, as a result of which the microphone capacitor is short-circuited. Since the diaphragm at the pull-in point is in equilibrium of forces, each external force effect results in a diaphragm deflection, which is counteracted by no or only a very slight spring force. Consequently, the sensitivity of the diaphragm is highest at the pull-in point. If a MEMS microphone is to be operated in the range of maximum sensitivity, the electrical bias voltage at the microphone capacitor must be continuously monitored and regulated to the pull-in voltage. The pull-in voltage of MEMS microphones typically lies in the range of 5 V through 8 V. For regulating the electrical bias voltage of MEMS microphones, regulators are therefore used in practice, the output stage of which is able to regulate voltages of this magnitude.

SUMMARY

The present invention relates to regulating the base voltage, which is applied to the measuring capacitor, in a low-voltage range. This makes it possible to omit a high-voltage output driver. Consequently, the electricity demand of the circuit is reduced as well as the ASIC area required for the circuit.

There are various possibilities for implementing such regulation of the base voltage at the measuring capacitor as well as for its circuitry-wise implementation.

In a first method variant, a predefined and non-variable base potential in the order of the setpoint voltage is applied to one electrode side of the measuring capacitor. A regulatable counter-potential, which is low compared to the base potential, is applied to the other electrode side of the measuring capacitor. This counter-potential is then regulated in such a way that the potential difference at the measuring capacitor corresponds to the setpoint voltage.

This first method variant may be implemented simply in analog circuitry using standard transistors. In one preferred specific embodiment, the means for regulating the electrical bias voltage at the measuring capacitor of a MEMS sensor element include in this case a first voltage source, which delivers a voltage in the order of the setpoint voltage and is connected to the first electrode side of the measuring capacitor as a predefined base potential $n_1$, a second voltage source, which delivers a voltage which is low in comparison to this and is connected to the other second electrode side of the measuring capacitor as counter-potential $n_2$, an operational amplifier A, the inverting input of which is connected to the second electrode side of the measuring capacitor and whose output is fed back to its inverting input via a defined capacitance $C_{int}$, and a regulator connected downstream from the output of operational amplifier A, the second input of the regulator being connected to the first voltage source as reference voltage $n_1$, and whose output is fed back to the non-inverting input of operational amplifier A. In this way, counter-potential $n_2$ present at the inverting input of operational amplifier A is regulated on the second electrode side of the measuring capacitor via the output signal of the regulator.

Very different regulators may be used in this specific embodiment. However, an analog PI controller having a processing logic connected upstream proves to be particularly suitable. Such a PI controller includes at least one operational amplifier $A_{PI}$, which is fed back via a defined capacitance $C_1$ and a resistor R2, and a resistor R1 is connected upstream of its inverting input.

Another method variant for the regulation of the base voltage at the measuring capacitor according to the present invention provides for determining the difference between the capacitance of the measuring capacitor and a reference capacitance, the reference capacitance corresponding to the capacitance of the measuring capacitor when the setpoint voltage is applied. The base voltage applied to the measuring capacitor is subsequently regulated as a function of the determined capacitance difference.

This second method variant may advantageously be implemented simply with the aid of circuit means for digitizing the output signal. Thus, in a preferred circuitry-wise implementation of this method variant, the means for regulating the electrical bias voltage at the measuring capacitor include a voltage source, which is used as a voltage supply for a Wheatstone bridge. In this Wheatstone bridge, the measuring capacitor is interconnected with a reference capacitance $C_{ref}$ and two additional capacitances $C_1$ and $C_2$, and specifically in such a way that the output signal of the Wheatstone bridge corresponds to the deviation of the potential difference at the measuring capacitor from the setpoint voltage. The output signal of the Wheatstone bridge is supplied to an operational amplifier A, downstream from which are connected a filter and a quantizer. The output signal of the quantizer is fed back to the Wheatstone bridge, so that the potential difference at the measuring capacitor is regulated via the bit stream of the quantizer.

In terms of circuitry, it is in particular simple if reference capacitance $C_{ref}$ corresponds to the capacitance of the measuring capacitor when the setpoint voltage is applied and the two capacitances $C_1$ and $C_2$ are essentially identical.

The regulation according to the present invention may be based on an arbitrary setpoint voltage. The setting or regulation of the pull-in voltage at the measuring capacitor of a MEMS sensor element represents only one particularly advantageous application of the measures according to the present invention. These may be used in any stress-sensitive capacitive sensor element, even if they prove to be advantageous in particular in connection with MEMS microphones.

BRIEF DESCRIPTION OF THE DRAWINGS

As discussed above, there are various options for developing and refining the present invention in an advantageous manner. For this purpose, reference is made to the following description of two exemplary embodiments of the present invention based on the figures.

DETAILED DESCRIPTION OF EXAMPLE EMBODIMENTS

The exemplary embodiments described below relate in each case to a MEMS microphone including one microphone capacitor $C_{MIC}$ for signal detection, an electrical bias voltage being applied to it for increasing the microphone sensitivity. This bias voltage is intended to be regulated to the pull-in voltage of the MEMS microphone element. For that purpose, a base voltage is applied to microphone capacitor $C_{MIC}$ in both exemplary embodiments and regulated in such a way that the potential difference between the two electrode sides of microphone capacitor $C_{MIC}$ corresponds to the pull-in voltage. According to the present invention, this regulation of the base voltage is implemented in the low-voltage range.

Figure 1:
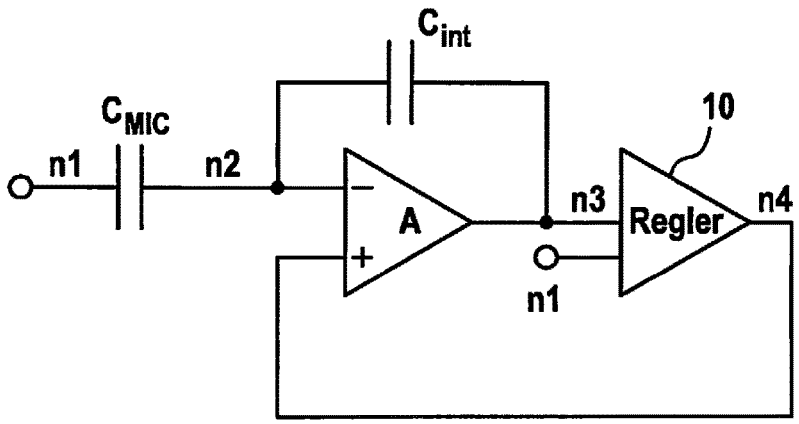
FIG. 1 shows the circuitry-wise design of a MEMS microphone including a first circuitry variant for regulating the electrical bias voltage at microphone capacitor $C_{MIC}$.

In the first exemplary embodiment shown in FIG. 1, the base voltage at microphone capacitor $C_{MIC}$ is implemented with the aid of two voltage sources, each of which is connected to one electrode side of microphone capacitor $C_{MIC}$. The one voltage source delivers a voltage in the order of the setpoint voltage, i.e., the pull-in voltage, and is connected to one electrode side of microphone capacitor $C_{MIC}$ as a predefined non-variable base potential n1. The other voltage source delivers a voltage which is low in comparison to this and is connected to the other electrode side of microphone capacitor $C_{MIC}$ as counter-potential n2. The base voltage at microphone capacitor $C_{MIC}$ results as the difference between base potential and counter-potential (n1–n2). At least base potential n1 is applied in the form of a modulation voltage. This may be, for example, a square-wave voltage, which may be implemented simply using two voltages and one selection switch.

In the specific embodiment of the present invention described here, base voltage (n1–n2) is regulated to the pull-in voltage, in that the first electrode side of microphone capacitor $C_{MIC}$ is held at high base potential n1, while low counter-potential n2 on the second electrode side of microphone capacitor $C_{MIC}$ is regulated accordingly. In MEMS microphones, the pull-in voltage normally lies in the range of 5 V through 8 V. Voltage n1 applied on the first electrode side must be accordingly high.

In the exemplary embodiment represented here, the regulation of lower counter-potential n2 takes place with the aid of an operational amplifier A used as a charge integrator and a regulator 10, the circuitry-wise integration of which is explained in greater detail in connection with FIG. 2.

The second electrode side of microphone capacitor $C_{MIC}$ is connected to the inverting input of operational amplifier A, so that counter-potential n2 is thus applied here. Output n3 of operational amplifier A is on the one hand fed back to its inverting input via a defined integration capacitance $C_{int}$. On the other hand, output n3 of operational amplifier A is supplied to one input of regulator 10. The second input of regulator 10 is connected to the first voltage source as reference voltage. Fixed base potential n1 is thus present at this input, the first electrode side of microphone capacitor $C_{MIC}$ being held on this base potential. Output n4 of regulator 10 is fed back to the non-inverting input of operational amplifier A.

Since the difference of the inputs of operational amplifier A is regulated to zero, the inverting input does not follow the non-inverting input. In this way, counter-potential n2 on the second electrode side of microphone capacitor $C_{MIC}$ may be controlled via output signal n4 of regulator 10 and consequently also the base voltage (n1–n2) present at microphone capacitor $C_{MIC}$.

Figure 2:
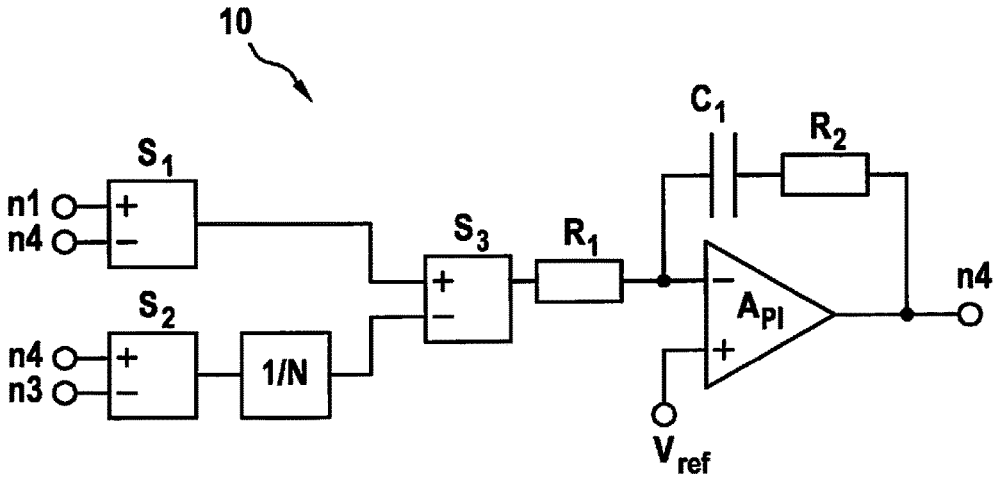
FIG. 2 shows the circuit diagram of a regulator 10 for the circuitry variant shown in FIG. 1.

FIG. 2 represents an embodiment variant for regulator 10. The core element is a PI controller made up of an amplifier API, a capacitance $C_1$ and two resistors R1 and R2. Resistor R1 is connected upstream from the inverting input of amplifier API.

The non-inverting input of amplifier API is connected to a reference potential $V_{ref}$, which corresponds to 0 V in the exemplary embodiment represented here. Output n4 of amplifier API is fed back to its inverting input via resistor R2 and capacitance C1. Three subtractors $S_1$, $S_2$, $S_3$ and one factor N or 1/N are connected upstream from resistor R1, so that a zero is output at the output of subtractor $S_3$, when the following condition is met: $C_{MIC}=N\cdot C_{int}\cdot C_{MIC}$ denotes here the capacitance of the microphone capacitor. Its capacitance at the pull-in point may be determined simply by reducing the base distance of the capacitor electrodes to ⅔ in the capacity calculation. Since integration capacitance $C_{int}$ of operational amplifier A is known, factor N may be calculated simply and implemented accordingly in the circuitry.

Amplifier API subsequently delivers an output voltage N4, which is used to set counter-potential n2 on one electrode side of microphone capacitor $C_{MIC}$ in such a way that the base voltage (n1–n2) corresponds to the pull-in voltage of microphone capacitor $C_{MIC}$.

Figure 3:
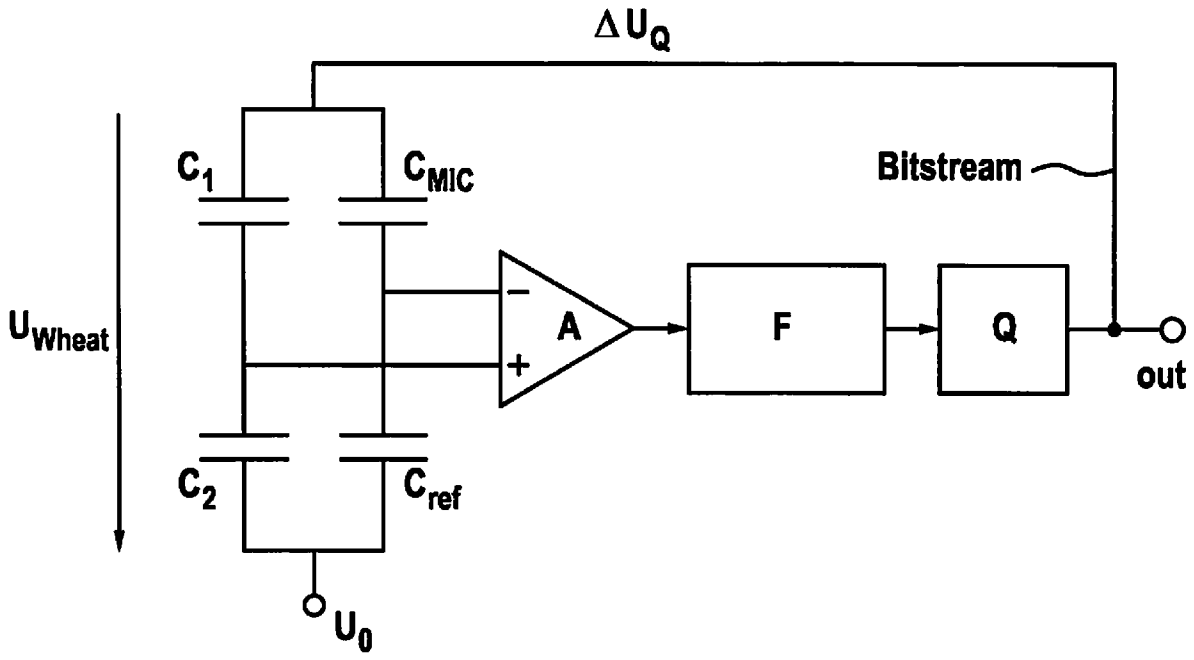
FIG. 3 shows the schematic design of a MEMS microphone including a second circuitry variant for regulating the electrical bias voltage at microphone capacitor $C_{MIC}$.

In the second exemplary embodiment shown in FIG. 3, microphone capacitor $C_{MIC}$ is interconnected with a reference capacitance $C_{ref}$ and two additional capacitances $C_1$ and $C_2$ in a Wheatstone bridge. This bridge circuit is fed from a separate fixed voltage source $U_0$, which delivers a voltage in the order of double the pull-in voltage. Reference capacitance $C_{ref}$ and additional capacitances $C_1$ and $C_2$ are selected and interconnected in such a way that the output signal of the Wheatstone bridge corresponds to the deviation of the voltage present at microphone capacitor $C_{MIC}$ from the corresponding pull-in voltage. In the simplest case, reference capacitance $C_{ref}$ corresponds to the capacitance of microphone capacitor $C_{MIC}$ when the pull-in voltage is applied and the two capacitances $C_1$ and $C_2$ are generally identical.

In this second exemplary embodiment, the base voltage present at microphone capacitor $C_{MIC}$ is not regulated directly, but instead indirectly, in that the voltage present at the Wheatstone bridge is regulated as a function of its output signal. For this purpose, the output signal of the Wheatstone bridge is fed to an operational amplifier A. A filter F and a quantizer Q are connected downstream from it. This is advantageously a delta-sigma modulator for digitizing the output signal. The digitized output signal is fed back to the Wheatstone bridge, so that $U_{Wheat}=U_0+\Delta U_Q$, $\Delta U_Q$ corresponding to the bit stream of quantizer Q. This causes voltage $U_{Wheat}$ at the Wheatstone bridge to be regulated in such a way that the capacitance of microphone capacitor $C_{MIC}$ corresponds to reference capacitance $C_{ref}$. This means that the potential difference at microphone capacitor $C_{MIC}$ is regulated to the pull-in voltage via bit stream $\Delta U_Q$ of quantizer Q. For this purpose, the pulse density of bit stream $\Delta U_Q$ is adjusted in such a way that on average the voltage, which is required for the pull-in operation of microphone capacitor $C_{MIC}$, is generated.

Since the voltage contribution of bit stream $\Delta U_Q$ is very small compared to $U_0$ and also to the base voltage at microphone capacitor $C_{MIC}$, the regulation of the base voltage at microphone capacitor $C_{MIC}$ takes place here also in a low-voltage range.

What is claimed is:

1. A method for regulating an electrical bias voltage at a measuring capacitor of a MEMS sensor element having a first electrode side and a second electrode side, the second electrode side being connected to an inverting input of an operational amplifier, an output of the operational amplifier being connected to an input of a regulator, and an output of the regulator being fed back to a non-inverting input of the operational amplifier, the method comprising:

applying a base voltage to the first electrode side of the measuring capacitor, and subsequently regulating the base voltage in such a way that a potential difference between both electrode sides of the measuring capacitor corresponds to a setpoint voltage, the regulation of the base voltage taking place in a low-voltage range;

applying a predefined and non-variable base potential in the order of the setpoint voltage to the first electrode side of the measuring capacitor; and applying a regulatable counter-potential which is low in comparison to the base voltage to the second electrode side of the measuring capacitor, the counter-potential being regulated in such a way that the potential difference at the measuring capacitor corresponds to the setpoint voltage, wherein the regulatable counter-potential is regulated on the second electrode side of the measuring capacitor via the output of the regulator that is supplied to the non-inverting input of the operational amplifier.

2. An arrangement for regulating an electrical bias voltage at a measuring capacitor of a MEMS sensor element, comprising:

a first voltage source which delivers a voltage in the order of a setpoint voltage and is connected to a first electrode side of the measuring capacitor as a predefined base potential;

a counter-potential which is low in comparison to the base potential and which is applied to the second electrode side of the measuring capacitor;

an operational amplifier, an inverting input of the operational amplifier being connected to the second electrode side of the measuring capacitor and an output of the operational amplifier is fed back to the inverting input via a defined capacitance;

a regulator connected downstream from the output of operational amplifier, the regulator having an output fed back to a non-inverting input of operational amplifier, so that a counter-potential present at the inverting input of the operational amplifier is regulated on the second electrode side of the measuring capacitor via an output signal of the regulator.

3. The regulating arrangement as recited in claim 2, wherein the regulator is an analog PI controller having a processing logic connected upstream and the PI controller includes at least one operational amplifier, which is fed back via a defined capacitance and a resistor, and a resistor being connected upstream from its inverting input.

4. A method of using of regulating arrangement, comprising:

providing a regulating arrangement, the regulating arrangement including a first voltage source which delivers a voltage in the order of a setpoint voltage and is connected to a first electrode side of the measuring capacitor as a predefined base potential, a counter-potential which is low in comparison to the base potential and which is applied to the second electrode side of the measuring capacitor, an operational amplifier, an inverting input of the operational amplifier being connected to the second electrode side of the measuring capacitor and an output of the operational amplifier is fed back to the inverting input via a defined capacitance, and a regulator connected downstream from the output of operational amplifier, the regulator having an output fed back to a non-inverting input of operational amplifier, so that a counter-potential present at the inverting input of the operational amplifier is regulated on the second electrode side of the measuring capacitor via an output signal of the regulator; and one of: setting a pull-in voltage at the microphone capacitor of a microphone element as an electrical bias voltage using the regulating arrangement, or setting a pull-in voltage at the measuring capacitor of an acceleration sensor element as an electrical bias voltage using the regulating arrangement.

* * * * *